US012109459B2

(12) United States Patent
Sun

(10) Patent No.: US 12,109,459 B2
(45) Date of Patent: Oct. 8, 2024

(54) MULTIFUNCTIONAL TRAMPOLINE

(71) Applicant: GAOYOU KANGSHENG MACHINERY CO., LTD., Jiangsu (CN)

(72) Inventor: Bisheng Sun, Jiangsu (CN)

(73) Assignee: GAOYOU KANGSHENG MACHINERY CO., LTD. (CN)

( * ) Notice: Subject to any disclaimer, the term of this patent is extended or adjusted under 35 U.S.C. 154(b) by 419 days.

(21) Appl. No.: 17/361,297

(22) Filed: Jun. 28, 2021

(65) Prior Publication Data

US 2022/0347507 A1 Nov. 3, 2022

Related U.S. Application Data

(63) Continuation of application No. PCT/CN2021/100364, filed on Jun. 16, 2021.

(30) Foreign Application Priority Data

Apr. 30, 2021 (CN) ..... 202110480070.1

(51) Int. Cl.

| | |
|---|---|
| ***A63B 5/11*** | (2006.01) |
| ***A63B 9/00*** | (2006.01) |
| ***A63B 63/00*** | (2006.01) |
| ***A63B 63/08*** | (2006.01) |
| ***A63G 9/00*** | (2006.01) |

(52) U.S. Cl.

CPC ..... *A63B 5/11* (2013.01); *A63B 63/004* (2013.01); *A63B 63/083* (2013.01); *A63G 9/00* (2013.01); *A63B 2009/006* (2013.01)

(58) Field of Classification Search

CPC ..... A63B 5/11; A63B 5/00; A63B 63/004; A63B 63/083; A63B 2009/006; A63B 2067/005; A63B 17/04; A63B 2208/12; A63G 9/00; A63G 21/04

See application file for complete search history.

(56) References Cited

U.S. PATENT DOCUMENTS 3,312,471 A * 4/1967 Nissen ..... A63B 5/11 182/139
5,984,837 A * 11/1999 Weaver ..... A63B 9/00 160/DIG. 15

(Continued)

FOREIGN PATENT DOCUMENTS

GB 2461335 A * 1/2010 ..... A63B 5/11

*Primary Examiner* — Loan B Jimenez
*Assistant Examiner* — Kathleen M Fisk

(57) ABSTRACT

The invention discloses a multifunctional trampoline, which relates to the field of children's entertainment. The utility model relates to a multifunctional trampoline, which comprises a football frame. The left wall surface of the football frame is fixedly provided with a bottom support frame, the outer thread of the bottom support frame is provided with a top vertical strut, the upper end surface of the bottom support frame is welded with a circular frame, and the circular frame is formed by inserting a multi end arc frame and fixedly connecting with bolts, and the top surface of the circular frame is provided with a trample cloth, The top vertical strut is provided with a top connecting device, and the inner side of the top connecting device is fixedly connected with a purse seine, the inner side of the top vertical strut is provided with an arc contact block.

8 Claims, 8 Drawing Sheets

(56) References Cited

U.S. PATENT DOCUMENTS

| | | | | |
|---|---|---|---|---|
| 6,988,967 | B2 * | 1/2006 | Allison | A63B 63/00 473/473 |
| 7,481,740 | B2 * | 1/2009 | Colling | A63B 71/0054 482/28 |
| 7,762,927 | B1 * | 7/2010 | Gordon | A63B 5/11 482/35 |
| 7,909,738 | B2 * | 3/2011 | Chen | A63G 9/00 482/28 |
| 8,328,695 | B2 * | 12/2012 | Ronan | A63B 71/022 135/156 |
| 8,764,611 | B2 * | 7/2014 | Chen | A63B 24/0084 482/28 |
| D718,827 | S * | 12/2014 | Chen | D21/797 |
| 9,339,676 | B2 * | 5/2016 | Publicover | A63B 5/11 |
| 10,076,697 | B1 * | 9/2018 | Publicover | A63B 71/0054 |
| 10,258,854 | B2 * | 4/2019 | Chen | A63B 5/11 |
| 10,702,785 | B1 * | 7/2020 | Chen | A63B 71/03 |
| 10,758,763 | B1 * | 9/2020 | Chen | A63G 9/00 |
| 2002/0185049 | A1 * | 12/2002 | Broderick | A63B 9/00 114/264 |
| 2013/0225304 | A1 * | 8/2013 | Hsieh | F24F 5/0035 239/200 |
| 2014/0080674 | A1 * | 3/2014 | Chen | A63B 5/11 482/29 |
| 2017/0340939 | A1 * | 11/2017 | Chen | A63B 67/10 |
| 2020/0368597 | A1 * | 11/2020 | Colling | A63B 63/004 |
| 2021/0228967 | A1 * | 7/2021 | Mann | A63B 71/022 |
| 2022/0001226 | A1 * | 1/2022 | Chen | A63B 71/022 |

* cited by examiner

MULTIFUNCTIONAL TRAMPOLINE

CROSS-REFERENCE TO RELATED APPLICATIONS

This application is a bypass continuation application of PCT application no.: PCT/CN2021/100364. This application claims priorities from PCT Application No.

PCT/CN2021/100364, filed Jun. 16, 2021, and from the Chinese patent application 202110480070.1 filed Apr. 30, 2021, the contents of which are incorporated herein in the entirety by reference.

TECHNICAL FIELD

The invention relates to the field of children's entertainment, in particular to a multifunctional trampoline.

BACKGROUND

Trampolines belong to comprehensive sports equipment. Children need firm will and confidence to play on a trampoline, which can cultivate their brave spirit. Trampolines are a kind of children's sports equipment, which are commonly used in kindergartens or children's playgrounds. They are suitable for children aged 3-6. In addition, trampolines have special uses, such as sports training. At present, trampolines have the problem of less exercise items; there is the problem of insufficient protection of equipment in the process of children's exercise; and the device is difficult to disassemble and transport. Therefore, those skilled in the art provide a multifunctional trampoline to solve the problems raised in the above background technology.

SUMMARY

The purpose of the invention is to provide a multifunctional trampoline to solve the problems raised in the above background technology.

In order to achieve the above purpose, the invention provides the following technical scheme: a multifunctional trampoline, including a football frame, the left wall of the football frame is fixedly installed with a bottom support frame, and the outer thread of the bottom support frame is installed with a top vertical strut, the upper end face of the bottom support frame is welded with a circular frame, and the circular frame is formed by multi end arc frame insertion and bolt fixed connection. The top surface of the circular frame is installed with a trample cloth, the top vertical strut is connected with a top connecting device, and the inner side of the top connecting device is fixedly connected with a purse seine, the inner side of the top vertical strut is positioned next to an arc contact block, the inner side of the arc contact block is installed with a trampoline, the outer thread of the top vertical strut is connected with a triangular net, and the inner side of the triangular net is installed with a shooting device. A fixed bracket is positioned to the right of the arc contact block, and the bottom surface of the fixed bracket is connected with a swing seat, a flying disk is positioned next to the swing seat, and a children's slide is positioned next to the flying disk, the children's slide is installed on the circular frame, and the left side of the children's slide is connected with an up and down ladder. The football frame and the bottom support frame are connected by a horseshoe connecting device, which has the advantages of a plurality of children's exercise equipment and good safety performance.

Preferably, the football frame comprises a first assembly straight bar, the top of the first assembly straight bar is fixed with the first assembly bending bar by insertion and secured with bolts, a connecting block is installed at the back of the first assembly straight bar, and the connecting block is connected with the first assembly straight bar by the first connecting screw, which can provide shooting function for children.

Preferably, the top connecting device comprises a gourd head, the bottom of the gourd head is sheathed on the upper end of the top vertical support rod through a base inserting rod, and a connecting rope is wound on the outer side of the gourd head, and the other side of the connecting rope is wound on the upper end of the purse seine, which can stably connect the purse seine.

Preferably, the shooting device comprises a backboard, a threaded mounting plate is installed on the bottom thread of the backboard, and a basket is welded on the front side of the threaded mounting plate, so as to provide shooting function for children and prevent basketball from popping out during shooting.

Preferably, the fixing bracket comprises a main rod, the bottom surface of the main rod is welded with a floor plate, and both sides of the floor plate include anchor bolt holes, the top surface of the main rod is inserted and threaded with a second assembly bending rod, the right side of the second assembly bending rod is inserted with a second assembly straight rod, and the bottom surface of the second assembly straight rod is welded with a connecting chain, The right side of the second assembly straight rod is inserted with a three head connecting seat, and the bottom surface of the three head connecting seat is connected with a transverse stabilizer bar, which can stably support the swing seat.

Preferably, the flying disk comprises a disc ring, the top surface of the disc ring is installed with a driving screw through a bolt, and the top surface of the driving screw is welded to the bottom surface of the hook chain, so that the swing function can be realized.

Preferably, both sides of the top surface of the children's slide are fixedly installed with the slide side supporting rod, and the bottom surface of the slide side supporting rod is welded with a threaded square rod, the inner screw of the threaded square rod is fixed with a reinforcing support rod, and the bottom surface of the threaded square rod is welded with an upper welding ring, the bottom surface of the upper welding ring is equipped with a lower assembly ring, and the upper welding ring and the lower assembly ring are connected by fastening bolts on both sides, It can provide entertainment for children.

Preferably, the up and down ladder comprises a handrail, and the top surface of the handrail is welded with an overlap hook, the other side of the overlap hook is overlapped on the outside of the circular frame, the horseshoe connecting device comprises a horseshoe ring frame, the left wall surface of the horseshoe ring frame is connected with an installation hole plate, and the left wall surface thread of the installation hole plate is connected with a tightening nut, and the circular frame comprises an insertion hook. The back side of the inserting hook is welded with a connecting spring, and the other side of the connecting spring is welded with a triangle steel, and the left side of the triangle steel is wound with a winding cloth, which is convenient for children to climb the trampoline.

Preferably, the football frame, shooting device, children's slide, up and down ladder, swing seat, flying disk and their supporting components are installed around the trampoline, and the number, position and connection relationship can be set at will.

Compared with the prior art, the invention has the advantages of:

(1) A multifunctional trampoline is installed with a shooting device, a swing seat and other components. The overall exercise items of the device include children's football, swing, children's basketball, children's trampoline and children's slide. A shooting device and a triangular net are installed in the right front of the trampoline to facilitate children to shoot in the process of jumping on the trampoline, it can realize children's exercise, the football frame at the bottom of the device can provide shooting conditions for children, and the swing seat on the right side can provide swing exercise items for children. Through the integration of various exercise items, the overall comprehensiveness of the device is improved.

(2) The utility model relates to a multifunctional trampoline. In order to ensure the safety of the equipment in use, a purse seine is installed on the outer side of the trampoline to prevent children from falling off the trampoline in the process of jumping. The bottom surface of the purse seine is fixedly connected with the arc-shaped contact block by removing the buckle, which can be lifted when children enter through the ladder, then, a connecting device is fixed on the upper right side of the purse seine through the buckle, which can firmly connect the purse seine and improve the overall safety of the equipment.

(3) The utility model relates to a multifunctional trampoline, which makes the packing, transportation and on-site installation process of the trampoline more convenient through the detachable component structure.

In the picture: 1. Football frame; 101. The first assembly straight bar; 102. Connecting block; 103. First assembly bending rod; 104. A first connecting screw; 2. Bottom support frame; 3. Arc contact block; 4. Top connecting device; 401. Gourd head; 402. Base inserting rod; 403. Connecting rope; 5. Purse seine; 6. Triangular net; 7. Shooting device; 701. Backboard; 702. Threaded mounting plate; 703. Basket; 8. Trampoline mat; 9. Fixed bracket; 901. Main rod; 902. Floor plate; 903. Anchor bolt hole; 904. The second assembly bending rod; 905. The second assembly straight rod; 906. Connecting chain; 907. Three head connecting seat; 908. Transverse stabilizer; 10. Swing seat; 11. Flying disk; 1101. Hook chain; 1102. Disk ring; 1103. driving screw; 12. Child slide; 1201. Slide side supporting rod; 1202. Threaded square rod; 1203. Upper welding ring; 1204. Lower assembly ring; 1205. Fastening bolt; 1206. Reinforcing support rod; 13. Up and down ladder; 1301. Lap hook; 1302. Handrail; 14. Top vertical strut; 15. Trample cloth; 16. Horseshoe connection device; 1601. Horseshoe ring frame; 1602. mounting hole plate; 1603. Tightening nut; 17. Circular frame; 1701. Insertion hook; 1702. Connecting spring; 1703. Triangle steel; 1704. Winding cloth.

DETAILED DESCRIPTION

The technical solutions in the embodiments of the invention will be described clearly and completely in combination with the drawings in the embodiments of the invention. Obviously, the described embodiments are only part of the embodiments of the invention, not all of them. Based on the embodiments in the invention, all other embodiments obtained by ordinary technicians in the art without making creative work belong to the protection scope of the invention.

Figure 1:
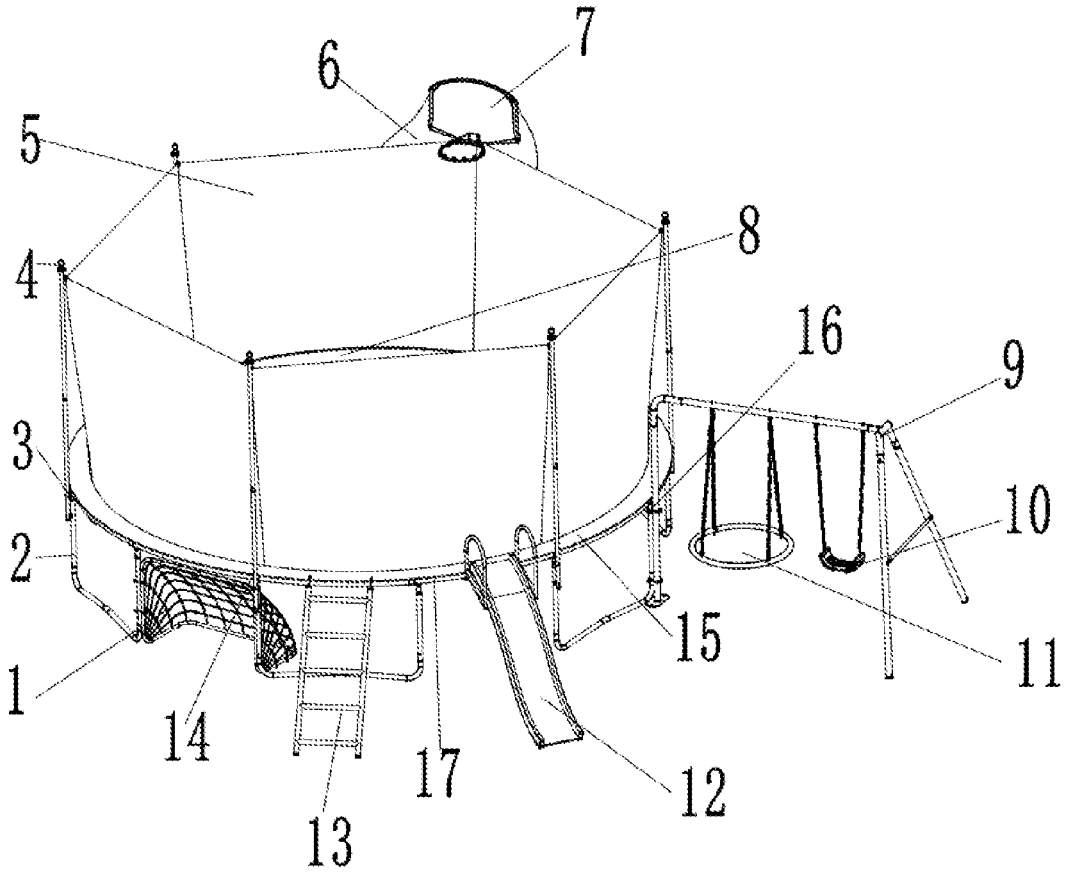
FIG. 1 is a structural diagram of the invention.
Figure 2:
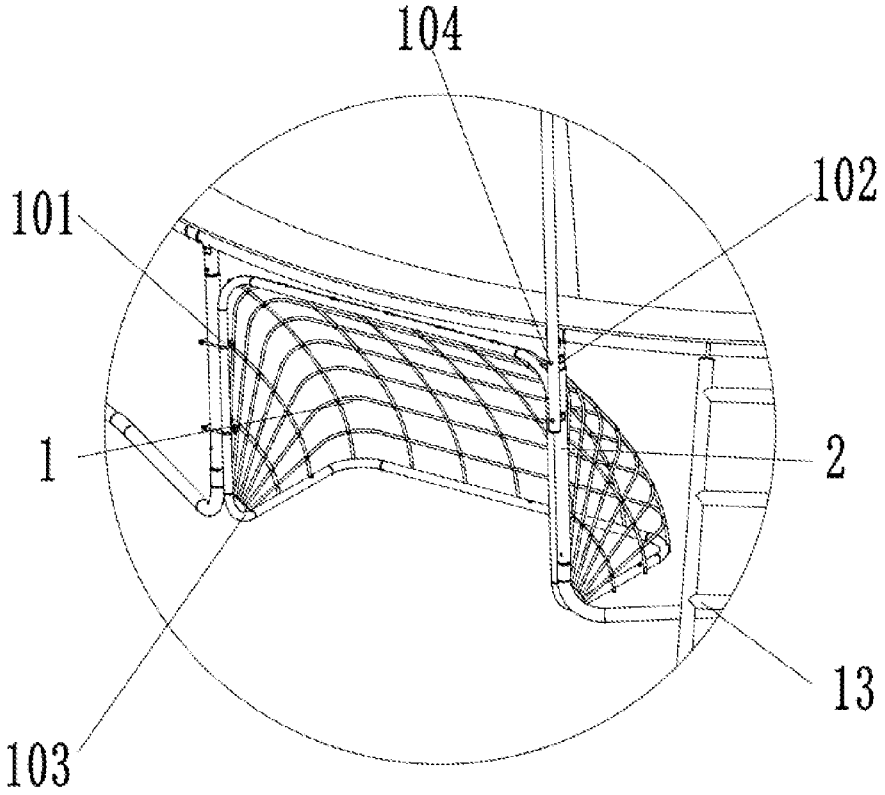
FIG. 2 is a partial structural diagram of the football frame in the invention.
Figure 3:
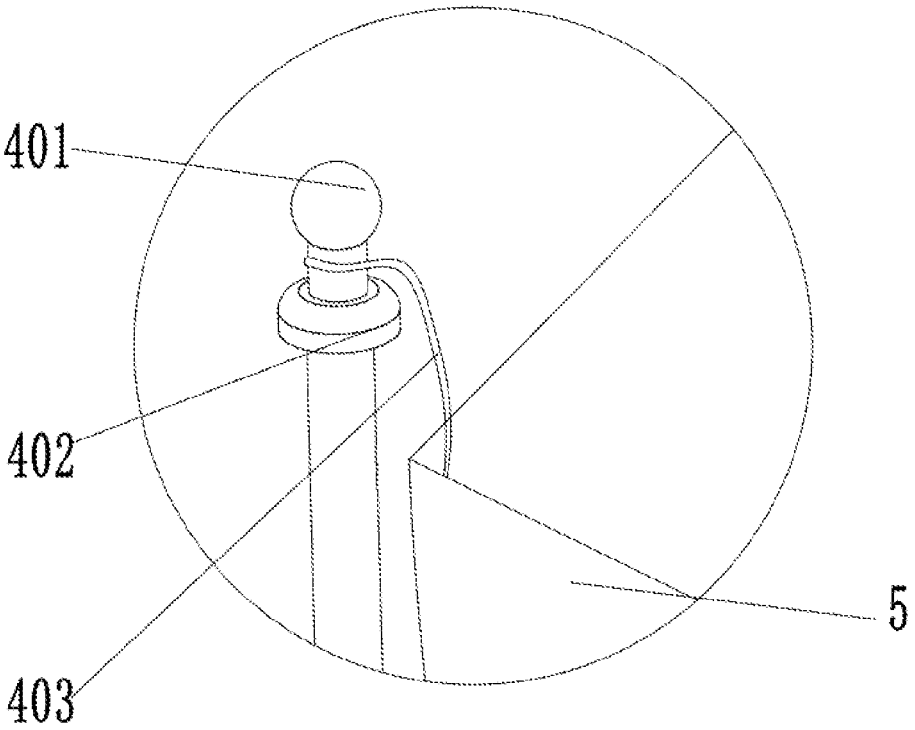
FIG. 3 is a partial structural diagram of the connecting device in the invention.
Figure 4:
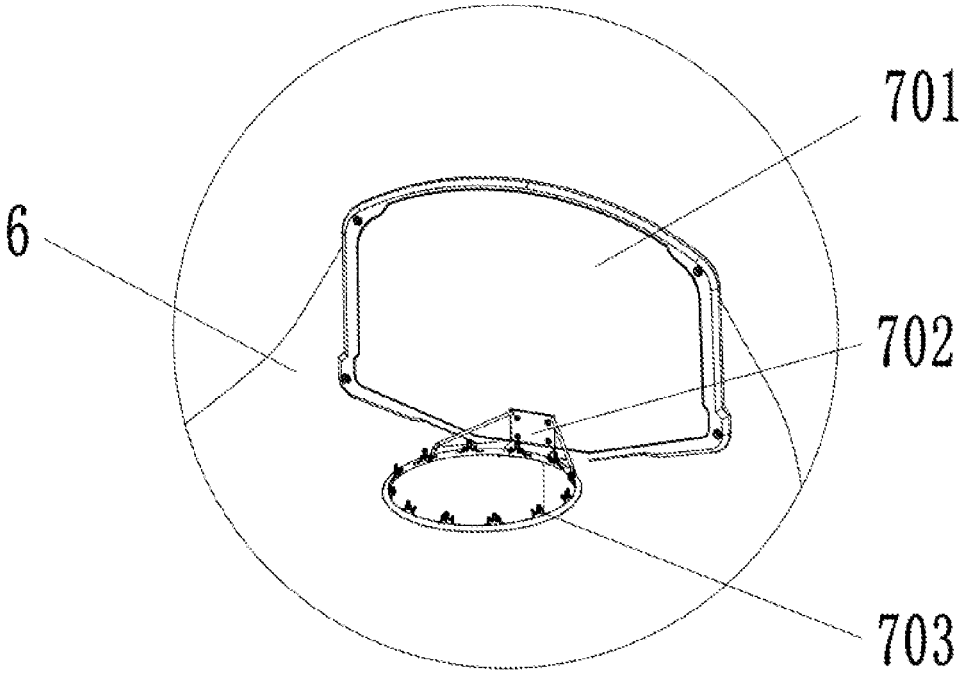
FIG. 4 is a partial structural diagram of the shooting device in the invention.
Figure 5:
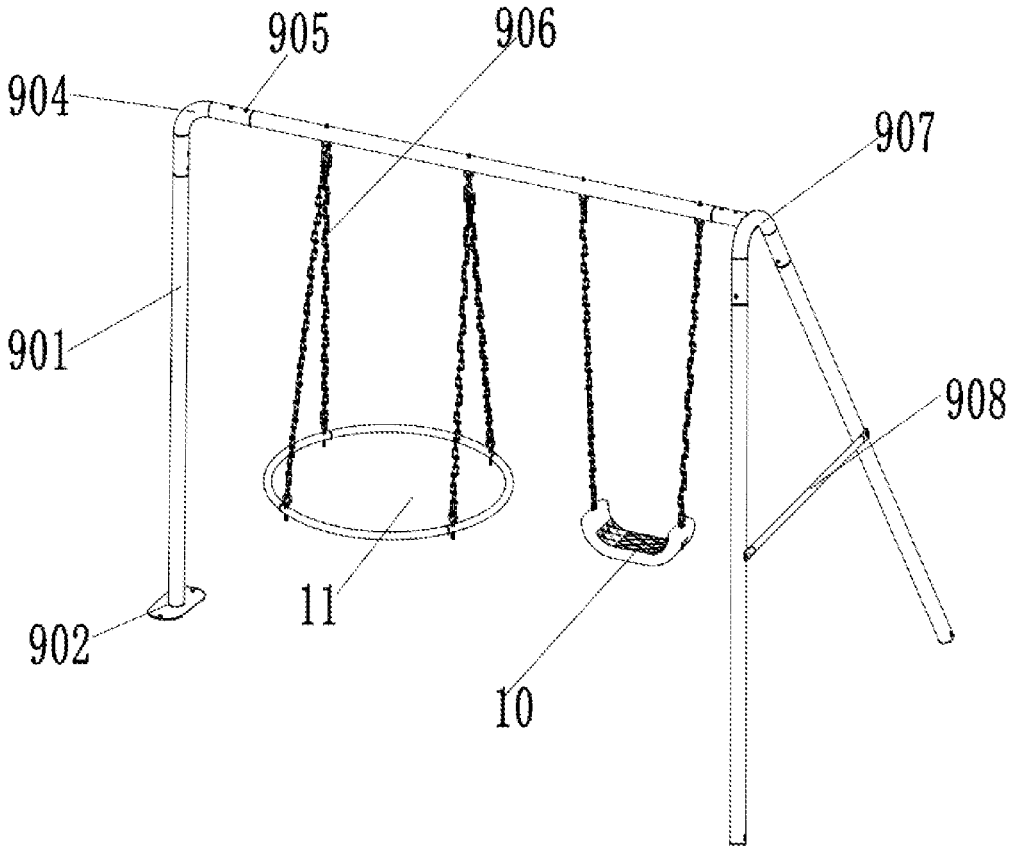
FIG. 5 is a partial structural diagram of the fixing bracket in the invention.
Figure 6:
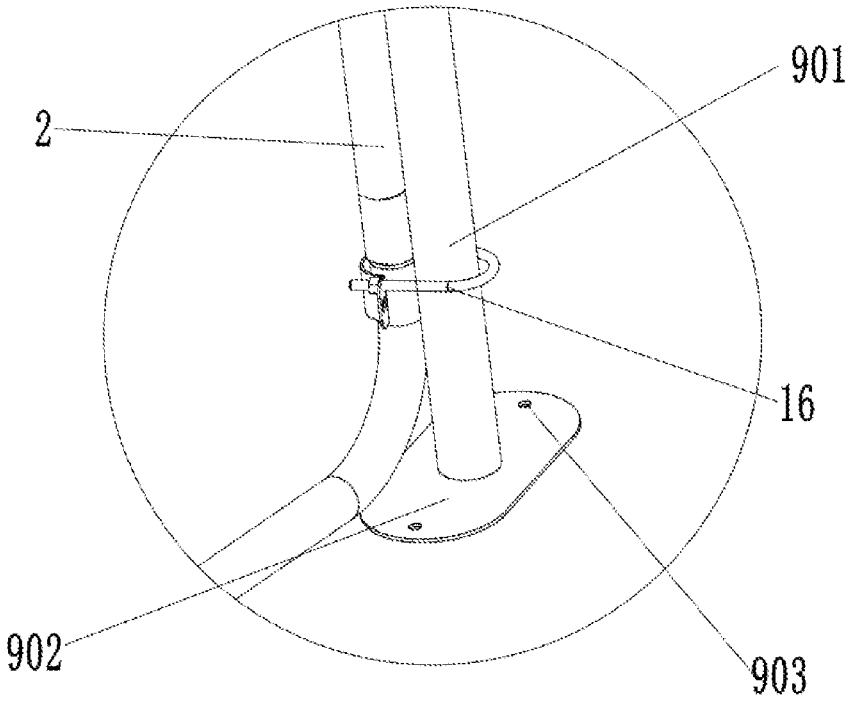
FIG. 6 is a partial structural diagram of the floor plate in the invention.
Figure 7:
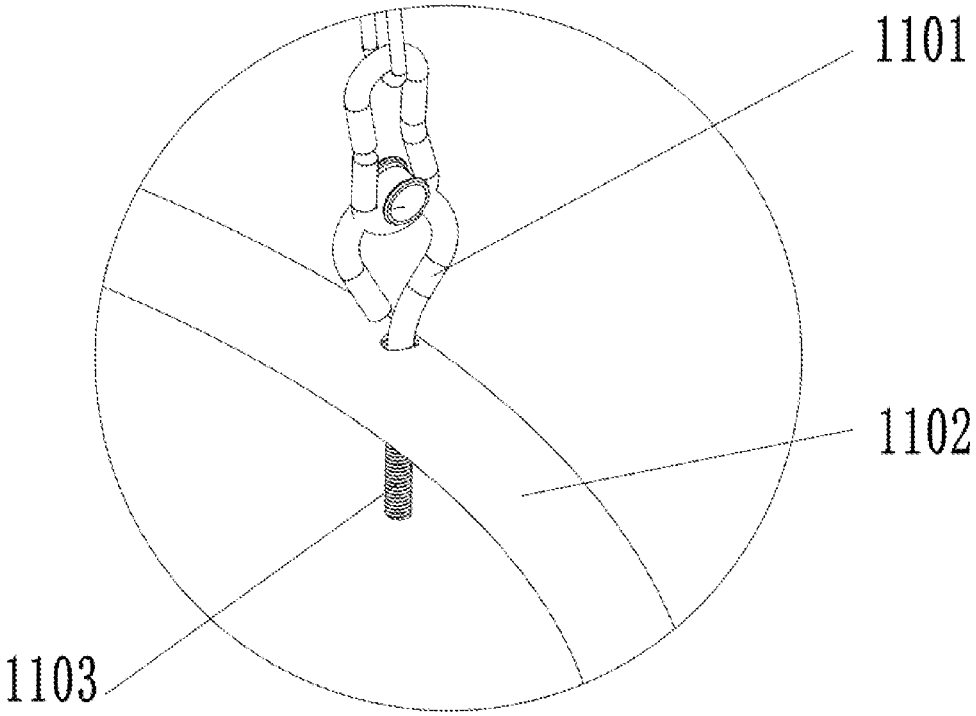
FIG. 7 is a partial structural diagram of the flying disk in the invention.
Figure 8:
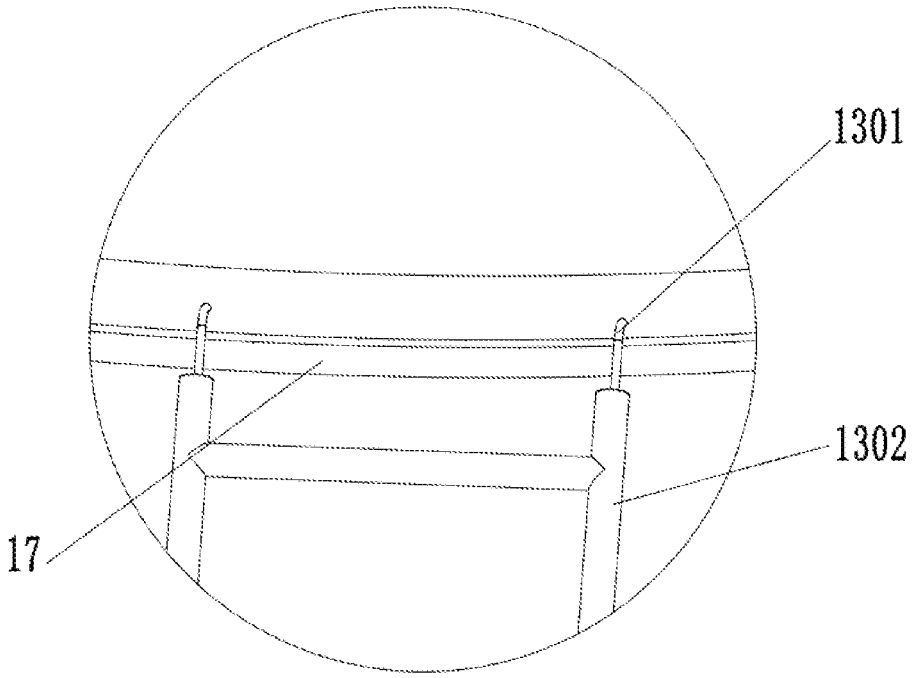
FIG. 8 is a partial structural diagram of the ladder in the invention.
Figure 9:
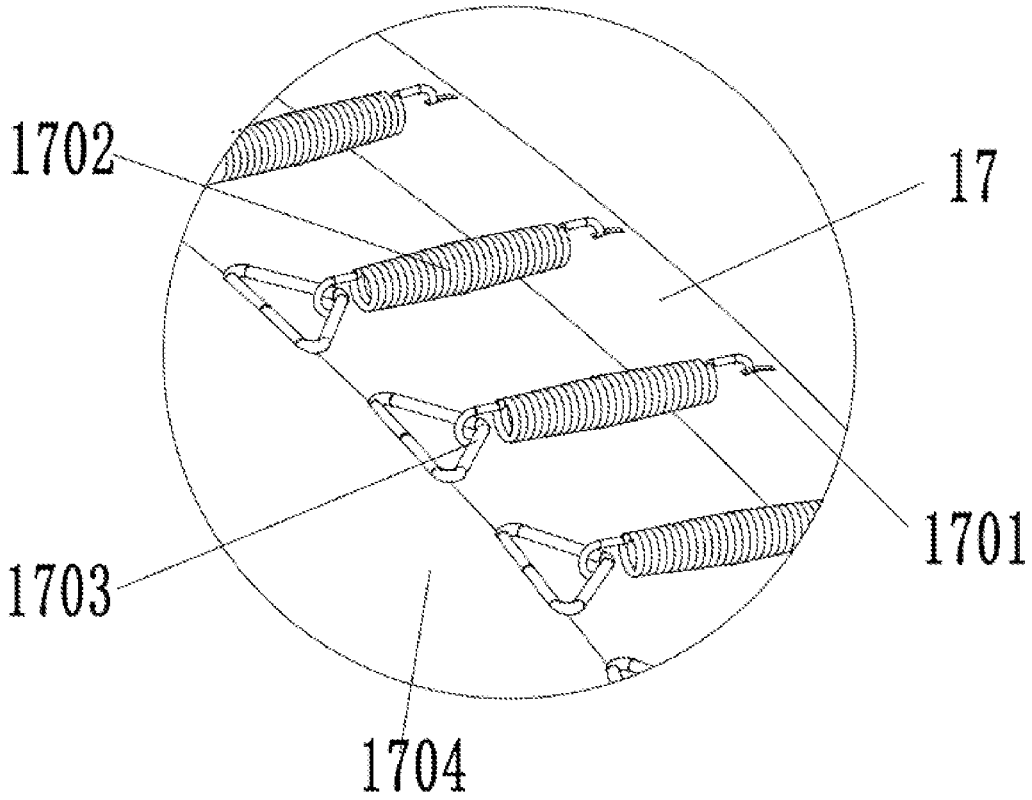
FIG. 9 is a partial structural diagram of the circular frame in the present invention.
Figure 10:
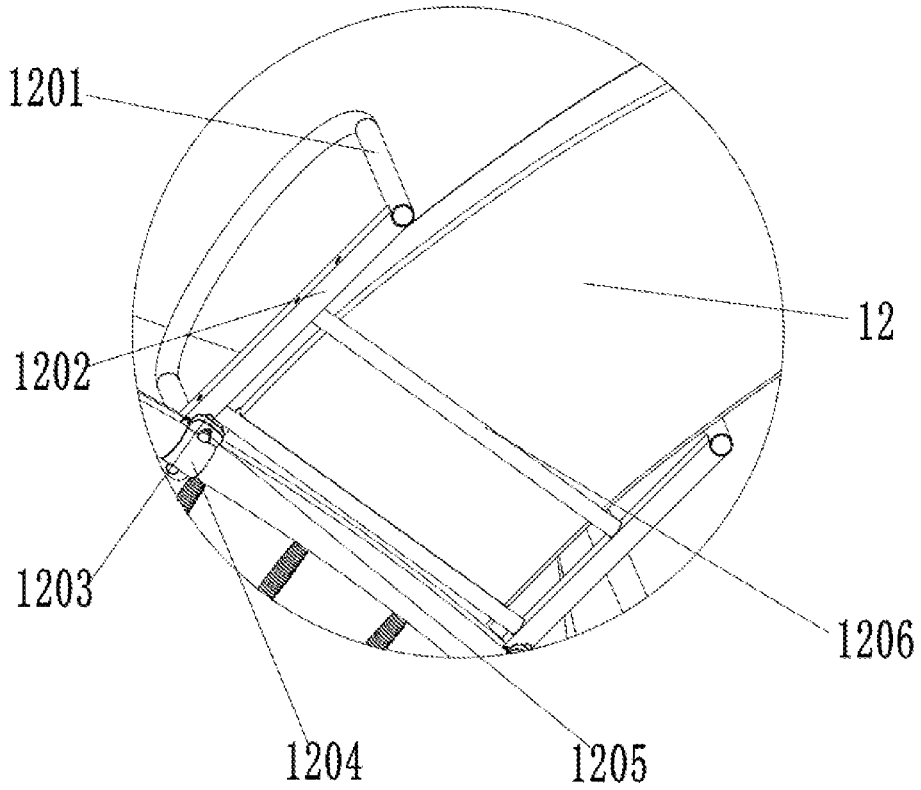
FIG. 10 is a partial structural diagram of the children's slide in the invention.
Figure 11:
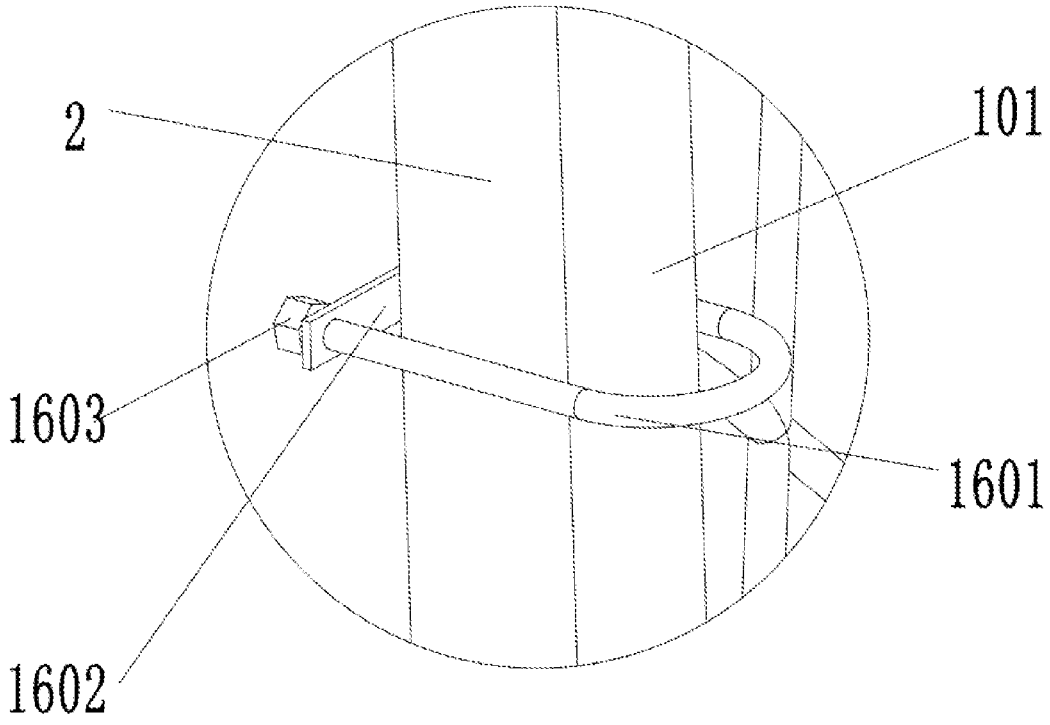
FIG. 11 is a partial structural diagram of the horseshoe connecting device of the present invention.

Please refer to FIG. 1-4. In the embodiment of the invention, a multifunctional trampoline includes a football frame 1, the left wall surface of the football frame 1 is fixedly installed with a bottom support frame 2, the outer thread of the bottom support frame 2 is installed with a top vertical strut 14, the upper end face of the bottom support frame 2 is welded with a circular frame 17, and the circular frame 17 is formed by multi end arc frame insertion and bolt fixed connection. The top surface of the circular frame 17 is installed with a trample cloth 15, the top vertical strut 14 is connected with a top connecting device 4, the inner side of the top connecting device 4 is fixedly connected with a purse seine 5, the inner side of the top vertical strut 14 is position next to an arc contact block 3, an inner side of the arc contact block is connected to a trample cloth (15), the outer thread of the top vertical strut 14 is connected with a triangular net 6, and the inner side of the triangular net 6 is installed with a shooting device 7. The right side of the arc contact block 3 is connected with a fixed bracket 9, and the bottom surface of the fixed bracket 9 is connected with a swing seat 10, a flying disk 11 is positioned next to the swing seat 10, and a children's slide 12 is positioned next to the flying disk 11, the children's slide 12 is installed on the circular frame 17, and the left side of the child slide 12 is connected with an up and down ladder 13. The football frame 1 and the bottom support frame 2 are connected by a horseshoe connecting device. The device has the advantages of a number of children's exercise equipment and good safety performance.

The football frame 1 comprises a first assembly straight bar 101, the top end of the first assembly straight bar 101 is fixed with the first assembly bending bar 103 by insertion and secured with bolts, the rear side of the first assembly straight bar 101 is connected with a connecting block 102, and the connecting block 102 is connected with the first assembly straight bar 101 by a first connecting screw 104, which can provide shooting function for children. The top connecting device 4 comprises a gourd head 401, the bottom of the gourd head 401 is sheathed on the upper end of the top vertical strut 14 through a base inserting rod 402, and a connecting rope 403 is wound on the outer side of the gourd head 401, and the other side of the connecting rope 403 is wound on the upper end of the purse seine 5, which can stably connect the purse seine 5. The shooting device 7 comprises a backboard 701, a threaded mounting plate 702 is installed on the bottom thread of the backboard 701, and a basket 703 is welded on the front side of the threaded mounting plate 702 to provide shooting function for children and prevent basketball from popping out during shooting. The fixed bracket 9 comprises a main rod 901, the bottom surface of the main rod 901 is welded with a floor plate 902, the two sides of the floor plate 902 include anchor bolt holes 903, the top surface of the main rod 901 is inserted and threaded with a second assembly bending rod 904, the right side of the second assembly bending rod 904 is inserted with a second assembly straight rod 905, and the bottom surface of the second assembly straight rod 905 is welded with a connecting chain 906. The right side of the second assembly straight rod 905 is inserted with a three head connecting seat 907, and the bottom surface of the three head connecting seat 907 is connected with a transverse stabilizer 908, which can stably support the swing seat 10. The flying disk 11 comprises a disk ring 1102, the top surface of the disk ring 1102 is installed with a driving screw 1103 through a bolt, and the top surface of the driving screw 1103 is welded on the bottom surface of the hook chain 1101, so that the swing function can be realized. The two sides of the top surface of the child slide 12 are fixedly installed with the slide side supporting rod 1201, and the bottom surface of the slide side supporting rod 1201 is welded with the threaded square rod 1202, the inner screw of the threaded square rod 1202 is fixed with the reinforcing support rod 1206, and the bottom surface of the threaded square rod 1202 is welded with the upper welding ring 1203, and the bottom surface of the upper welding ring 1203 is equipped with the lower assembly ring 1204. The upper welding ring 1203 and the lower assembly ring 1204 are connected by the fastening bolts 1205 on both sides, which can provide children with sliding entertainment items. The up and down ladder 13 comprises a handrail 1302, and the top surface of the handrail 1302 is welded with a lap hook 1301, the other side of the lap hook 1301 is lapped on the outside of the circular frame 17, the horseshoe connecting device 16 comprises a horseshoe ring frame 1601, the left wall surface of the horseshoe ring frame 1601 is connected with a mounting hole plate 1602, and the left wall surface thread of the mounting hole plate 1602 is connected with a tightening nut 1603, and the circular frame 17 comprises an insertion hook 1701. The connecting spring 1702 is welded on the rear side of the insertion hook 1701, the triangle steel 1703 is welded on the other side of the connecting spring 1702, and the winding cloth 1704 is wound on the left side of the triangle steel 1703, which is convenient for children to climb the trampoline.

Working principle: the main body of a multi-functional trampoline includes football frame 1, bottom support frame 2, arc contact block 3, top connecting device 4 and other parts. The equipment has many advantages of children's exercise equipment and good safety performance. The overall exercise items of the device include children's football, swing, children's basketball, children's trampoline 8 and child slide 12. A shooting device 7 and a triangle net 6 are installed in the right front of the trampoline mat 8, which is convenient for children to shoot in the process of jumping with trampoline mat 8 and can realize children's exercise. The football frame 1 at the bottom of the device can provide shooting conditions for children, The swing seat 10 on the right side can provide children with exercise items of swing. Through the integration of various exercise items, the overall comprehensiveness of the device is improved; In order to ensure the safety of the equipment in use, a purse seine 5 is installed on the outside of the trampoline mat 8, which can prevent children from falling off the trampoline mat 8 in the process of jumping. The bottom surface of the purse seine 5 is fixedly connected with the arc contact block 3 by removing the retaining ring, which can be lifted when children enter through the up and down ladder 13, and then fixed by the retaining ring. The top connecting device 4 is fixedly installed on the upper right side of the purse seine 5. The purse seine 5 can be firmly connected to improve the overall safety of the equipment. Because the whole device is supported by screws and a plurality of detachable rods, the main body of trampoline is made of cloth, which is convenient for carrying and transportation of the device, and has good folding and storage performance.

In the invention, the football frame 1, the shooting device 7, the child slide 12, the up and down ladder 13, the swing seat 10, the flying disk 11 and their supporting components are installed around the trampoline mat 8, and the number, the position and the connection relationship can be arbitrarily set, which are all within the protection scope of the invention.

In the description of the present invention, it should be understood that the orientation or position relationship indicated by the terms "coaxial", "bottom", "one end", "top", "middle", "other end", "top", "one side", "top", "inner", "front", "center", "both ends" is based on the orientation or position relationship shown in the drawings, It is only for the convenience of describing the invention and simplifying the description, rather than indicating or implying that the device or element referred to must have a specific orientation, be constructed and operated in a specific orientation, so it cannot be understood as a limitation of the invention.

In the invention, unless otherwise specified and defined, the terms "installation", "setting", "connection", "fixation" and "screw connection" shall be understood in a broad sense. For example, they can be fixed connection, detachable connection or integrated connection; It can be mechanical connection or electrical connection; It can be directly connected, or indirectly connected through an intermediate medium, or the internal connection of two components or the interaction between two components. Unless otherwise specified, for those skilled in the art, the specific meaning of the above technology in the invention can be understood according to the specific situation. Although the embodiments of the invention have been shown and described, it can be understood to those skilled in the art that a variety of changes, modifications, substitutions and variants can be made to these embodiments without departing from the principle and spirit of the invention, and the scope of the invention is defined by the appended claims and their equivalents.

The invention claimed is:

1. A multifunctional trampoline comprising:

a football frame (1); wherein a left wall surface of the football frame (1) is fixedly installed with a bottom support frame (2), the bottom support frame (2) is installed with a top vertical strut (14), an upper end surface of the bottom support frame (2) is welded with a circular frame (17), a top surface of the circular frame (17) is provided with a trample cloth (15), the top vertical strut (14) is provided with a top connecting device (4), an inner side of the top connecting device (4) is fixedly connected with a purse seine (5), an inner side of the top vertical strut (14) is provided with an arc contact block (3), an inner side of a top surface of the arc contact block (3) is connected to the trample cloth (15)

the top vertical strut (14) is provided with a triangular net (6), an inner side of the triangular net (6) is provided with a shooting device (7), a fixed bracket (9) is positioned to the right of the arc contact block (3), a bottom surface of the fixed bracket (9) is connected with a swing seat (10), a flying disk (11) is positioned adjacent to the swing seat (10), a child slide (12) is positioned to the left of the flying disk (11), the child's slide (12) is installed on the circular frame (17), an up and down ladder (13) is connected to the circular frame (17) adjacent to the child's slide (12), and the football frame (1) is connected with the bottom support frame (2) through a horseshoe connecting device (16).

2. The multifunctional trampoline according to claim 1, wherein the football frame (1) comprises a first assembly straight bar (101), and a connecting block (102) is connected with the bottom support frame (2) through a first connecting screw (104).

3. The multifunctional trampoline according to claim 1, wherein the top connecting device (4) comprises a gourd head (401), a bottom of the gourd head (401) is sleeved to an upper end of the top vertical strut (14) through a base insertion rod (402), an outer side of the gourd head (401) is wrapped with a connecting rope (403), and an opposite side of the connecting rope (403) is wound at the upper end of the purse seine (5).

4. The multifunctional trampoline according to claim 1, wherein the shooting device (7) comprises a backboard (701), a bottom thread of the backboard (701) is equipped with a threaded mounting plate (702), and a front side of the threaded mounting plate (702) is welded with a basket (703).

5. The multifunctional trampoline according to claim 1, wherein the fixed bracket (9) comprises a main rod (901), a bottom surface of the main rod (901) is welded with a floor plate (902), both sides of the floor plate (902) are provided with an anchor bolt hole (903), a top surface of the main rod (901) is inserted into a second assembly bending rod (904), the second assembly bending rod (904) is inserted and equipped with a second assembly straight rod (905), a bottom surface of the second assembly straight rod (905) is welded with a connecting chain (906), a right side of the second assembly straight rod (905) is equipped with a three head connecting seat (907), and a bottom surface of the three head connecting seat (907) is connected with a transverse stabilizer bar (908).

6. The multifunctional trampoline according to claim 1, wherein the flying disk (11) comprises a disc ring (1102), a top surface of the disc ring (1102) is installed with a driving screw (1103), and a top surface of the driving screw (1103) is welded to a bottom surface of a hook chain (1101).

7. The multifunctional trampoline according to claim 1, wherein a top surface of the child slide (12) is fixed with a slide side support bar (1201), a bottom surface of the slide side support bar (1201) is welded with a threaded square rod (1202), a screw of the threaded square rod (1202) is fixed with a reinforcing support rod (1206), a bottom surface of the threaded square rod (1202) is welded with an upper welding ring (1203), a bottom surface of the upper welding ring (1203) is equipped with a lower mounting ring (1204), and the upper welding ring (1203) and the lower mounting ring (1204) are connected by fastening bolts (1205).

8. The multifunctional trampoline according to claim 1, wherein the up and down ladder (13) comprises a handrail (1302), a top surface of the handrail (1302) is welded with a lap hook (1301), a side of the lap hook (1301) is overlapped on an outside of the circular frame (17), the horseshoe connecting device (16) comprises a horseshoe ring frame (1601), a left wall surface of the horseshoe ring frame (1601) is equipped with a mounting hole plate (1602), a tightening nut (1603) is installed on a left wall thread of the mounting hole plate (1602), the circular frame (17) includes an insertion hook (1701), a connecting spring (1702) is welded with a back side of the insertion hook (1701), the connecting spring (1702) is welded with a triangle steel (1703) on an opposite side of the connecting spring (1702), and a left side of the triangle steel (1703) is wrapped with a winding cloth (1704).

* * * * *